US005829591A

United States Patent [19]

Lyons

[11] Patent Number: 5,829,591

[45] Date of Patent: Nov. 3, 1998

[54] PACKING CONTAINER ASSEMBLY

[76] Inventor: William J. Lyons, R.D. 3 Box 247 A, DuBois, Pa. 15801

[21] Appl. No.: 929,026

[22] Filed: Sep. 15, 1997

Related U.S. Application Data

[63] Continuation-in-part of Ser. No. 627,048, Apr. 3, 1996, abandoned.

[51] Int. Cl.[6] ..... B65D 85/28

[52] U.S. Cl. ..... 206/373; 206/376; 206/443; 220/8; 220/367.1; 220/784

[58] Field of Search ..... 206/372, 373, 206/374, 375, 376, 377, 378, 379, 443; 220/8, 601, 367.1, 676, 315, 784, 786, 793, 794

[56] References Cited

U.S. PATENT DOCUMENTS

| | | | |
|---|---|---|---|
| 1,015,455 | 1/1912 | Neesham | 220/784 |
| 1,352,238 | 9/1920 | Arthur | 220/784 |
| 5,605,242 | 2/1997 | Hwang | 220/8 |
| 5,680,949 | 10/1997 | Roesler | 220/8 |

*Primary Examiner*—Paul T. Sewell
*Assistant Examiner*—Nhan T. Lam
*Attorney, Agent, or Firm*—James Ray & Associates

[57] ABSTRACT

A packing container assembly having an inner and an outer elongated hollow member each having a closed end and an open end, with the open end of the inner hollow member insertable into the open end of the outer hollow member to place the hollow members in longitudinal sliding engagement. A pair of interlocking devices are formed, one on an inner surface of the outer hollow member which comprises an inwardly extending protuberance, and the other on an outer surface of the inner hollow member, which comprises a plurality of spaced depressions extending inwardly from an inner wall surface thereof. The plurality of depressions are each adapted to receive the protuberance when the two members are joined together. A pair of elongated slots extending through the wall portion of the outer hollow member are provided on each side of the protuberance to enhance the flexibility of the wall portion at the protuberance and minimize any resistance to slidability at the interface. In a different embodiment, an outwardly extending thumb-tab is provided between the elongated slots to permit manual withdrawal of the protuberance from the depressions.

9 Claims, 3 Drawing Sheets

PACKING CONTAINER ASSEMBLY

CROSS REFERENCE TO RELATED APPLICATIONS

This application is a Continuation-In-Part of application Ser. No. 08/627,048, filed Apr. 3, 1996, now abandoned.

FIELD OF THE INVENTION

This invention relates generally to an elongated packing container especially suited for storing and shipping elongated objects of various lengths, such as cutting tools and the like. More particularly, this invention relates to a unique and improved packing container of the type having a pair of interfitted hollow members which can be adjusted to vary the length thereof and includes a unique, novel and improved interlocking system to better safeguard the container's contents without adversely effecting the ease with which the members can be joined either mechanically or manually and further includes means for adjusting the interlocking system to vary the tightness of the interlock, as may be necessary, to meet the requirements for differing automatic packing facilities, as well as vary the ease of manual manipulation.

BACKGROUND OF THE INVENTION

Variable length packing containers useful in automatic packing processes are well known in the art. In particular, such containers are known which are molded of a thin, relatively stiff plastic material as two hollow members, each having an open end and a closed end and adapted to be joined together with the open end of a smaller member insertable into the open end of a larger member and thus adapted for sliding engagement to adjust the length of the closed container. Interlocking means are normally provided on adjacent interfaces of the two members which are adapted to engage each other to hold the container in a closed position at any of several possible lengths. For example, U.S. Pat. No. 4,509,656, issued to Rösler, teaches a polygonal packing container in which at least two diagonal outside corners of the inner member are provided with a line of spaced outwardly extending protuberances which are adapted to engage inwardly projecting webs at diagonally opposed inside corners of the outer hollow members when a sliding engagement is effected. The plastic material from which the two members are fabricated is thin enough that the protuberances can be manually forced past the webs until the desired length is achieved, with each of the webs thereafter locked between a pair of adjacent protuberances. Upon manually opening or closing the container, one merely experiences a series a mildly resisting clicks as the protuberances are forced past the webs so that without the application of an opening or closing force, the adjusted relative positions of the two members will be maintained. Cylindrical shaped containers are also known, as shown in U.S. Pat. No. 4,210,253, also issued to Rösler, in which a row of axially aligned teeth on the outer surface of the inner member are adapted to engage a threaded cylindrical surface on the inner surface of the outer member to thereby reduce the frictional interfaces and minimize the manual closing and opening effort. Such a simple joining and interlocking effort readily lends itself to commercial, automatic packing with packing machines.

While the state of the art packing containers, such as those noted above, have well served their intended purposes, there have been some shortcomings, particularly in the container's ability to adequately protect the container's contents from damage. For example, the cylindrical containers, even though some are provided with a hexagonal head at one end, are known to roll-off from work table surfaces. If for example, such a container is holding a cutting bit for a machine tool, it is not unusual for such a fall to cause the bit to fall from the container and be chipped and thereby virtually destroy the tool. While the rectangular shaped storage containers are less likely to roll from a work table, it of course happens that the containers are, nevertheless, inadvertently dropped from time to time with the result that its contents can be damaged or destroyed. For these reasons it has been desirable to manufacture storage containers that are of heavier construction to better safeguard its contents and/or incorporate better interlocking means to reduce the probability that the container's contents will be dislodged and damaged should the container inadvertently fall to a floor or hard surface. Efforts to merely produce the prior art containers in heavier sections and/or design the interlocks with heavier interfering surfaces, however, have not proved successful. With such heavier sections and/or heavier interlocks flexibility is lost and the usual interlocking means do not work well to thereby complicate automatic packing processes, as well as, making it difficult to manually open and close the container.

SUMMARY OF THE INVENTION

This invention is predicated on my conception and development of a new and improved packing container of the type having a pair of interfitted hollow members which can be adjusted to vary the length of the container and includes unique, novel and improved interlock features to better safeguard the container's contents. By slight modifications of the manufacturing parameters, the interlock mechanism can be adjusted to vary the gripping force of the interlock to meet practically any specific requirements, particularly, as may be required to meet specifications for automatic packing facilities. The design of the inventive packing container is ideally suited for containers produced of a stiff plastic material having a wall thickness of at least about 0.03 inch, and ideally about 0.05 inch to better protect the container's contents, and incorporates a locking means ideally suited for such heavy wall thicknesses. More specifically, the inventive packing container of this invention is intended to have a polygonal cross-sectional configuration or at least one generally flat side surface formed by a pair of joined overlapping generally flat side surfaces of a pair of joined hollow members. As is common to the prior art containers, the container of this invention merely comprises a pair of interfitting members, each having a closed end and an open end such that the open end of the smaller hollow member is insertable into the open end of the larger hollow member to place the hollow members in a longitudinal sliding engagement relative to each other to form the container assembly.

A first interlocking means is formed on an inner surface of the outer hollow member and a second interlocking means is formed on an outer surface of the inner hollow member such that the first and second interlocking means cooperate to hold the two hollow members in fixed engagement with each other. The first interlocking means preferably comprises a protuberance extending inwardly from a wall portion of the outer hollow member, while the second interlocking means preferably comprises a plurality of aligned depressions extending outwardly from an adjacent outer wall surface of the inner hollow member with the plurality of depressions being spaced in the longitudinal direction of the hollow members with each depression having a cross-section adapted to receive and engage the protuberance extending inwardly from the adjacent outer hollow member. A pair of elongated slots, extending through the wall portion of the outer hollow member, are provided such that one each is disposed on each side of the protuberance. In some applications, an outwardly extending thumb-tab is provided between the elongated slots but slightly displaced from the first interlocking means on the inside surface of the outer hollow member, so that manually pressing of the thumb-tab will cause the first interlocking means on the inside surface of the outer hollow member to be pivoted outwardly away from the second interlocking means to release engagement altogether between the two locking means. Accordingly, the slots serve to isolate the protuberance on an elongated strip sub-portion of the first wall portion between the slot pair, which thereby permits the protuberance to be more easily deflected outwardly when the two members are moved relative to each other in a sliding engagement to open or close the container or adjust the length of the closed container. The thumb-tabs in being able to pivot the first interlocking means away from the inner hollow member can readily disengage the two interlocked members and virtually eliminate the effort and energy required to manually or mechanically open and close the container, particularly, when the packing container is fabricated with comparatively heavy wall sections and/or the interlocking means is comparatively heavy. By varying the length of the two slots, the flexibility of the elongated strip sub-portion from which the protuberance extends can be varied, which thereby permits the container to be manufactured to differing specific sliding engagement tolerances, as may be necessary to meet requirements for differing automatic packing facilities, as well as vary the ease of manual manipulation.

OBJECTS OF THE INVENTION

Accordingly, it is a primary object of this invention to provide a new and improved packing container of the type having a pair of interfitted hollow members which can be adjusted to vary the length thereof which is better suited for protecting its contents as compared to such containers of the prior art.

Another primary object of this invention is to provide a new and improved packing container of the type having a pair of interfitted hollow members which is ideally suited to be manufactured of a relatively thick plastic material to better safeguard the container's contents.

A further primary object of this invention is to provide a new and improved packing container of the type having a pair of interfitted hollow members which is ideally suited to be manufactured of a relatively thick stiff material such as plastic in which relatively heavy interlocking protuberances are provided to better safeguard the container's contents.

Still another primary object of this invention is to provide a new and improved packing container of the type having a pair of interfitted hollow members which is ideally suited to be manufactured of a relatively thick, stiff material such as plastic, and can be adjusted to vary the flexibility of the interlock mechanism to adjust the force and energy required to effect a sliding engagement to permit differing specific sliding engagement tolerances, as necessary, to meet requirements for differing automatic packing facilities.

An even further primary object of this invention is to provide a new and improved packing container of the type having a pair of interfitted hollow members which is ideally suited to be manufactured of a relatively thick, stiff material such as plastic, and having a locking means which not only can be adjusted to vary the flexibility of the interlock mechanism to adjust the force and energy required to effect a sliding engagement, but having means to manually completely disengage the interlock mechanism.

These and other objects and advantages of this invention will become apparent after a full reading of the following detailed description, particularly when read in conjunction with the attached drawings as described below.

DESCRIPTION OF THE PREFERRED EMBODIMENT OF THE INVENTION

Figure 1:
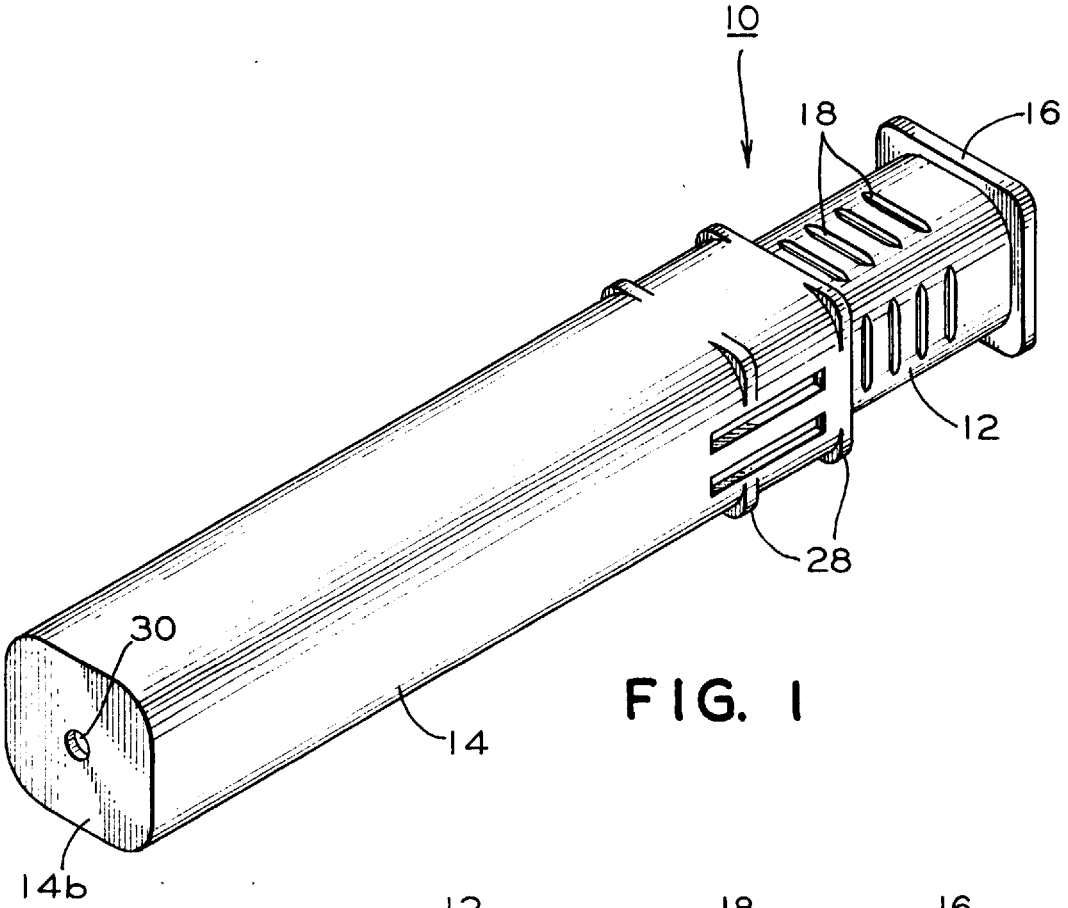
FIG. 1 is an isometric view of a packing container in accordance with a preferred embodiment of this invention showing the inner hollow member inserted within the outer hollow member.

Prior to proceeding with a detailed description of the subject invention, it is noted that for the sake of clarity, identical components which have identical functions have been identified with identical reference numerals throughout the several views of the attached drawings.

Reference to FIGS. 1–6 will illustrate a presently preferred embodiment of this invention wherein the packing container of this invention, generally designated 10, comprises an inner hollow member 12 insertable into outer hollow member 14. Ideally, the packing container 10 has a square or rectangular cross-section with rounded corners as illustrated in the drawings, but other polygonal cross-sectional forms can be utilized which may be necessary to contain items of unusual shape themselves. Hollow members 12 and 14 each have an open end 12*a* and 14*a* respectively, and a closed end 12*b* and 14*b* respectively as shown in the drawings, and comparative cross-sectional dimensions as will permit the open end 12*a* of inner hollow member 12 to be inserted into the open end 14*a* of outer hollow member 14 fitting relatively closely therein, but being sufficiently loose to permit a sliding engagement to be readily made manually. As an example, to produce a particular container having a square cross section shown in the drawings, one set of ideal dimensions have shown that the walls of the outer hollow member 14 be spaced by an inside dimension of 0.475 inch and to space the walls of the inner hollow member 12 by an outside dimension of 0.470 inch wherein the rounded corners of the outer hollow member 14 have an inside radius of 0.10 inch and the rounded corners of the inner hollow member 12 have an outside radius of 0.09 inch. With these dimensions the interfacing surfaces closely engage each other, but yet readily permit an easy joining effort and a manual sliding engagement without difficulty. It should be appreciated that the size and dimensions of the container 10 are not particularly critical apart from the fact that the relative dimensions, as exemplified above, should be comparatively controlled to achieve the interlocking relationship disclosed herein. While the overall dimensions will have to be chosen and developed depending on the contents to be placed in the container 10 it has been found that the length of the inner hollow member 12 should preferably be greater than the length of the outer hollow member 14 so that when the inner hollow member 12 is fully inserted its open end 12*a* will contact the inside, closed end 14*b* of outer hollow member 14 to naturally limit the extent to which it can be inserted thereby leaving its closed outer end 12*b* extending sufficiently to be easily grasped as necessary to open the container 10.

To further facilitate opening of the closed container 10, a flange 16 is preferably provided at the closed end 12*b* of inner hollow member 12 which provides a peripheral edge which can be manually gripped to permit pulling inner hollow member 12 from outer hollow member 14. While any form of flange will suffice, as shown in the drawings, a preferred flange 16 should ideally have a periphery that will mate and be aligned with the periphery of the outer hollow member 14 when adjacent thereto. Therefore, flange 16 is shown with a square periphery that is identical in size and periphery to the square periphery of the outer hollow member 14. With this relationship a closed packing container 10 can safely be supported upon a flat surface in that any one of the four, flat side surfaces of the outer hollow member 14 can rest on a flat supporting surface to provide support for the outer hollow member 14, while at the same time the closed end 12*b* of the inner hollow member 12 will be supported by a straight edge of flange 16 which will necessarily be parallel to the adjacent supporting face of outer hollow member 14 to any extend which inner hollow member 12 may extend away from the outer hollow member 14. Clearly, therefore, a heavy or unbalanced object within the closed container 10 will not cause the closed container 10 to rest unevenly on a flat supporting surface.

The crux of the invention resides in the interlocking means provided on the two hollow members 12 and 14. Specifically, a first interlocking means is provided on the inner hollow member 12 which comprises a plurality of spaced depressions 18 provided in at least one side face of the inner hollow member 12. In the embodiment illustrated, the depressions 18 are provided in each of the four faces of the rectangular inner hollow member 12 and as shown, comprise elongated, parallel and equally spaced slots or grooves spaced in the elongated direction of the inner hollow member 12 so that the elongated depressions 18 are parallel to the open and closed ends of inner hollow member 12. In the particular embodiment shown, the depressions 18 are grooves preferably each exhibiting a "V" cross-sectional depression such that the side wall of the depressions 18 are sloped outwardly from the pointed base of the depressions 18 to the parallel outer wall surfaces of the hollow wall member 12. As will be discussed below, other cross-sectional configurations can be utilized.

A second interlocking means must be provided on and inside surface of the outer hollow member 14 which is adapted to engage the first interlocking means on the inner hollow member 12. Specifically, at least one of the inside flat surfaces of outer hollow member 14 is provided with a protuberance 20 extending inwardly near the open end thereof. The placement, size and cross-section of protuberance 20 should, in general, be comparable to the size and cross-section of the depressions 18 and disposed so that protuberance 20 will readily "snap-fit" into any one of depressions 18 when the two hollow members 12 and 14 are joined together in a sliding engagement as intended. Obviously, therefore, in the embodiment illustrated, the inside edges of protuberances 20 should have a "V" cross-sectional form so that the protuberances 20 will in fact readily "snap-fit" into any adjacent depression 18 and engage the sloped sides thereof. By then forcing a sliding motion relative to the two engaged hollow members 12 and 14, the sloped side walls of depressions 18 will force the protuberances 20 to be deflected outwardly to effectively disengage it from the depressions 18 and permit continuation of the sliding motion and a "snap-fit" of the protuberances 20 into the next adjacent depressions 18 and so on. Accordingly, when no force is being applied to effect a sliding engagement, the two protuberances 20 will be engaged within opposed depressions 18 to hold the container 10 in a closed position.

Although a protuberance 20 can be provided on any one or more of the flat inside surfaces of outer hollow member 14, including all four of the flat inside surfaces if desired, it has been found that providing but two such protuberances 20 on directly opposed flat surfaces, as shown in the drawings, is quite adequate to provide a suitable interlock without unduly restricting the slidability of the joined hollow members 12 and 14 if the depth of engagement of protuberance 20 within depression 18 is adequate. That is to say, to adequately safeguard the contents of the packing container 10, the wall portions of the hollow members 12 and 14 should be as heavy as practical for the purpose and the mass and depth of protuberances 20 engaged within depressions 18 should be optimized to assure a good solid interlocking relationship. Even though only two protuberances 20 are preferably provided on opposed inside surfaces of outer hollow member 14 it is, nevertheless, preferable that the depressions 18 be provided on all four surfaces of inner hollow member 12 so that the two members can be joined and locked regardless of their relative orientations thereby eliminating any need to assure proper alignment.

When the above design objective is optimized, it may be found that the flexibility of the two hollow members 12 and 14 is inadequate to permit an easy manual sliding engagement to close and open the packing container 10 and perhaps inadequate to meet particular slidability requirements for specific automatic packing facilities. Accordingly, to assure an easy manual manipulation and low effort slidability, a pair of slots 24 are provided through the wall portion of outer hollow member 14, one on each side of protuberance 20 having their elongated direction preferably parallel to the elongated direction of the outer hollow member 14 with the protuberance 20, in general, centrally disposed between the two slots 24. Accordingly, protuberances 20 will be isolated and centrally positioned on a strip or bridge-like sub-portion 26 of the wall portion. With this construction, the wall sub-portion 26 from which the protuberances 20 extend inward; i.e., strips 26, will not be reinforced by other areas of the two wall portions at right angles thereto, so that when the packing container 10 is opened and closed and the protuberances 20 thereby are forced to be deflected outwardly as they are forced from one pair of depressions 18 to the adjoining pair of depressions 18, those strips 26 can more easily be deflected outwardly to reduce the resistance that would otherwise be experienced. Accordingly, the strips 26 function like a leaf spring permitting the protuberances 20 to be more easily deflected to facilitate a sliding engagement. It should be apparent that the flexibility of the strips 26 will be a function of their length. Therefore, the flexibility of the strips 26 as well as the relative slidability of the two components can be controlled by varying the length of the slots 24. Accordingly, if the manufacturer wishes to tighten the gripping action between the two hollow members he can shorten the length of the slots 24 and visa versa.

Another practice that may be desirable in some applications is to provide the slots 24 only partially extending through the wall portion of outer hollow member 14. In this way, the flexibility of strips 26 will be minimal, thereby assuring a good tight interlock for purposes of shipping the product therein. Thereafter the purchaser or user of the product therein, can choose to cut through the remainder of the uncompleted slots 24 with a knife point, or the like, thereby rendering the container 10 easier to open and close and perhaps more suitable for use as a storage container.

While not essential, the outer hollow member 14 may also have a means or flange member to provide a finger grip to further facilitate manual manipulation in combination with flange 16 on inner hollow member 12. As discussed above, the finger grip flange 16 as described is designed so that it does not interfere with the flat supporting surfaces of the outer hollow member 14, but rather enhances such support by providing flange edges that are parallel to the rectangular periphery of the outer hollow member 14. In line with this design objective, any finger grip flange 28 on outer hollow member 14 should preferably avoid any configuration that would interfere with such a flat support. Accordingly, as shown in the drawings, the finger grip flange 28 on the outer hollow member 14 also preferably has a square periphery identical in size and configuration to that of flange 16 on inner hollow member 12. However, since those peripheral sides of flange 16 are positioned and sized to mate with the flat sides of the outer hollow member 14 itself, the periphery of flange 28 should itself not extend beyond the side surfaces of outer hollow member 14, and accordingly, the only place that flange 28 can protrude from outer hollow member 14 is at the rounded corners, as shown in the drawings, such that the flange corners extend beyond the rounded corners of the outer hollow member 14. Since the corners of the flange 28 are also preferably rounded, this merely means that the radius of curvature of the flange 28 at the corners is less than the radius of curvature of the outer hollow member 14 at the corners. This then leaves a small triangular finger-grip portion at each of the corners which will readily facilitate manual manipulation. As actually shown in the drawings, two such finger grip flanges 28 are preferred, preferably disposed on either side of slots 24. While such a flange 28, or pair of such flanges 28, can be disposed at any point along the length of outer hollow member 14, the placement as shown provides a pair of advantages in that gripping the outer hollow member 14 near the open end 14*a* will render it a bit easier to insert the open end of inner hollow member 12 thereinto and by placing a finger and thumb between the two flanges 28 as shown in the drawings, one will be able to feel the deflection of strip 26 against the finger and/or thumb to render an enhanced sense of control when a sliding engagement is being effected manually. Conversely, by placing a finger and thumb on those surfaces at right angles to the strips 26, one will be able to squeeze those two sides together to force the strips 26 apart to thereby reduce the frictional forces when the two hollow members 12 and 14 are being subjected to a relative sliding movement. Conversely, by placing one's finger tips directly over the two strips 26 in essence pinching the two strips 26 together, one can feel their deflection when a sliding engagement is being effected to control and even stop the sliding engagement with only a moderate pinching force.

Figure 7:
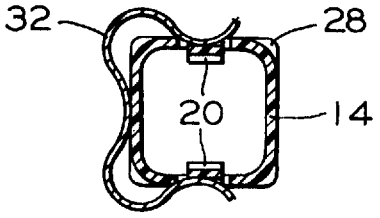
FIG. 7 is a cross-sectional view of the outer hollow member substantially as illustrated in FIG. 5, but in section and showing an optional spring-lock in place thereon that may be utilized to lock the two hollow members together in a closed position.
Figure 9:
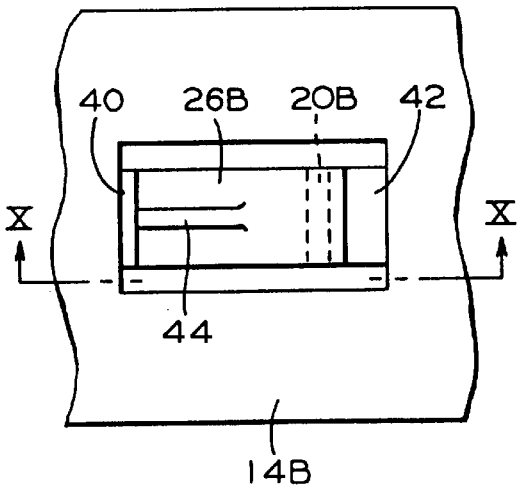
FIG. 9 is a plan view of the thumb-tab illustrated in FIG. 8 further showing a plan view of a living web incorporated therewith.
Figure 8:
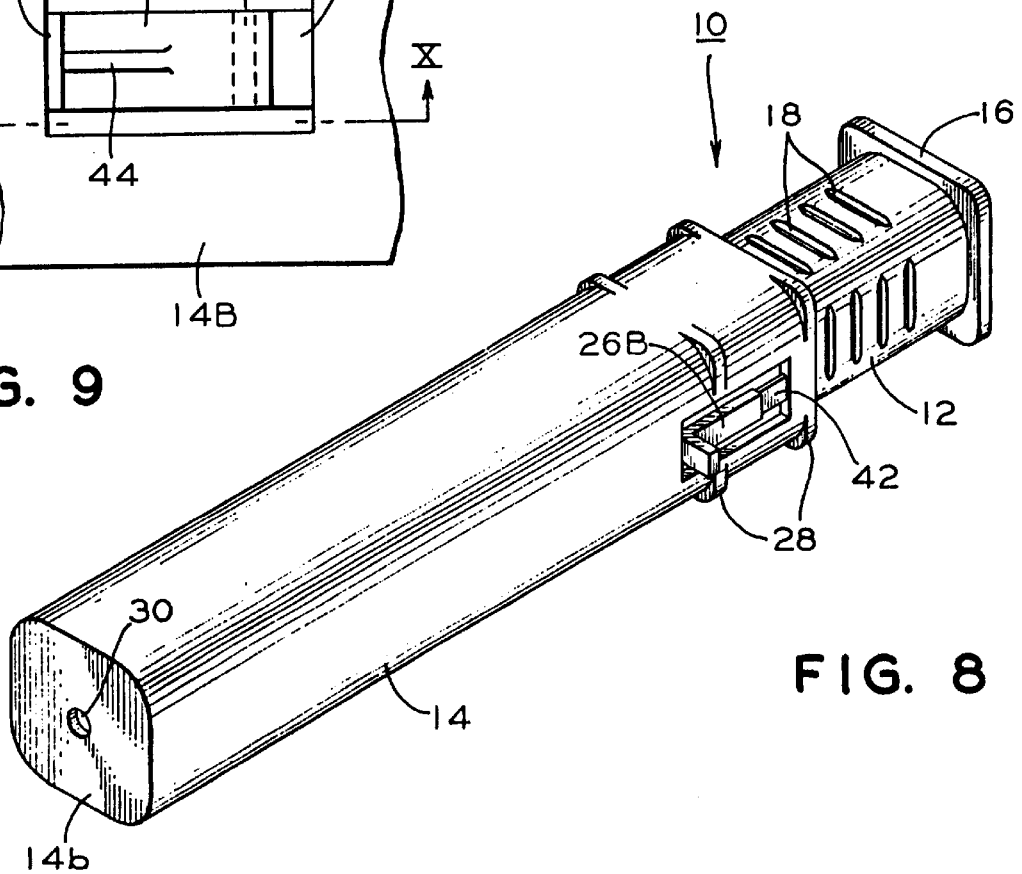
FIG. 8 is an isometric view of a packing container in accordance with another preferred embodiment of this invention, substantially like that shown in FIG. 1, except that it includes a thumb-tab capable of completely disengaging the interlocking means.
Figure 10:
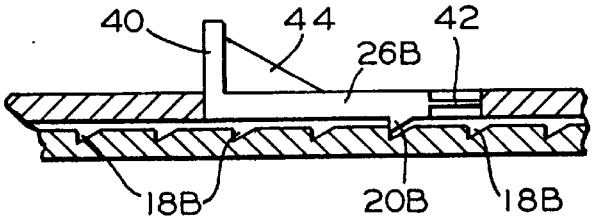
FIG. 10 is a partial, sectional side view of the container shown in FIGS. 8 and 9, taken at section line X—X of FIG. 9, further illustrating a side view of the thumb-tab and associated components.

Reference to FIG. 7 will illustrate on optional spring-lock 32 that can be utilized in combination with the closed container 10 to virtually lock the container 10 in a closed position. Specifically, as noted above, even a moderate pinching force on strips 26 will force and hold protuberances 20 tightly within the depressions 18 within which they are biased. Accordingly, spring-lock 32 merely comprises a generally C-shaped form of spring steel adapted to be clipped onto the side of outer hollow member 14 such that opposed inside edges thereof will forcefully pinch together the two strips 26 to thereby prevent the sliding separation of the two hollow members 12 and 14 without removing the spring-lock 32. Obviously, spring-lock 32 can be provided in any of a number of different forms from that shown, provided it is adapted to clip onto outer hollow member 14 such that strips 26 are pinched together thereby.

Another factor that may need consideration is that of air passage. Specifically, if the two hollow members 12 and 14 are too closely spaced, closing and/or opening the packing container 10 may create an air pressure of air vacuum that will hinder such action more than desired. Any such air pressure or air vacuum problem can be eliminated by providing a small air aperture 30 (FIG. 1) through any wall portion of either of the hollow wall members 12 or 14. Ideally, such an air aperture 30 should be placed in either of the closed end walls so that the overlapping side wall does not block the aperture to defeat its intended purpose.

Figure 2:
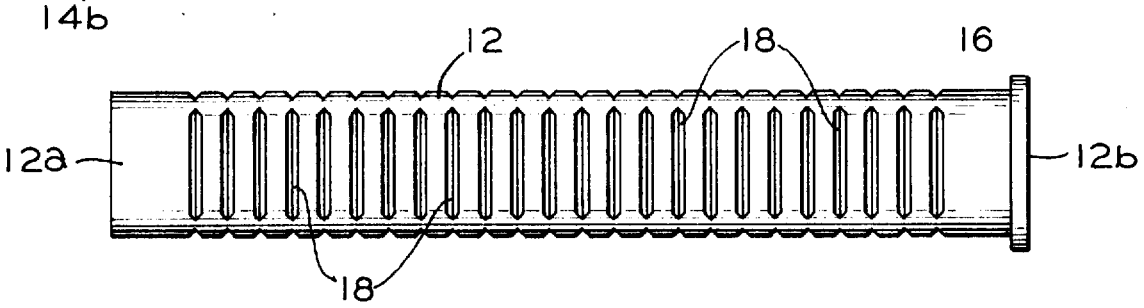
FIG. 2 is a side view of the inner hollow member illustrated in FIG. 1.
Figure 3:
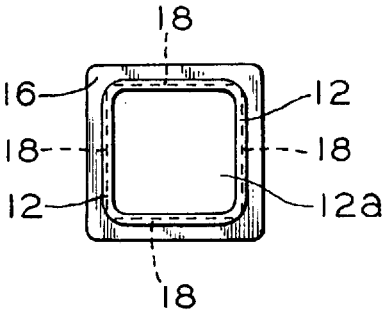
FIG. 3 is an end view of the inner hollow member illustrated in FIGS. 1 and 2 as viewed from the open end.
Figure 11:
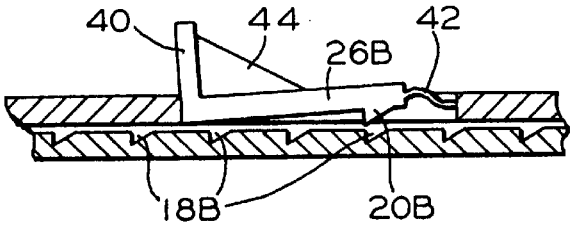
FIG. 11 is identical to FIG. 10 except that it shows the thumb-tab in a depressed position as necessary to disengage the interlock mechanism.

Reference to FIGS. 8–11 will illustrate another embodiment of the packing container of this invention wherein a thumb-tab 40 is provided which is capable of completely disengaging the interlocking mechanism, namely completely withdrawing protuberance 20B from depressions 18B. The inner hollow member 12, as shown in FIG. 2, can be utilized in this embodiment of the invention without any modifications. The outer hollow member 14B, while virtually identical to outer hollow member 14, shown in FIG. 1 does differ in having a thumb-tab 40 extending outwardly from the strip, or sub-wall portion 26B, which should not be directly over protuberance 20B, but rather displaced to be adjacent to one or the other end of strip 26B. In some applications, particularly where relatively heavy material is involved, it may be preferable to include a living web 42 at the opposite end of strip 26B that is opposite to the end having thumb-tab 40. As depicted in FIG. 11, a pressure applied against thumb-tab 40 will cause the length of strip 26B to be bowed upwardly, thereby lifting protuberance 20B completely out of contact with any of depressions 18B. As further shown in FIG. 11, the inclusion of a living web 42 having a thinner cross-section is more easily deflected. As further shown in FIGS. 8–11, thumb-tab 40 is reinforced with a triangular support 44 to thereby assure a bowing action of strip 26B as opposed to merely bending thumb-tab 40 downwardy when a force is applied.

Figure 6:
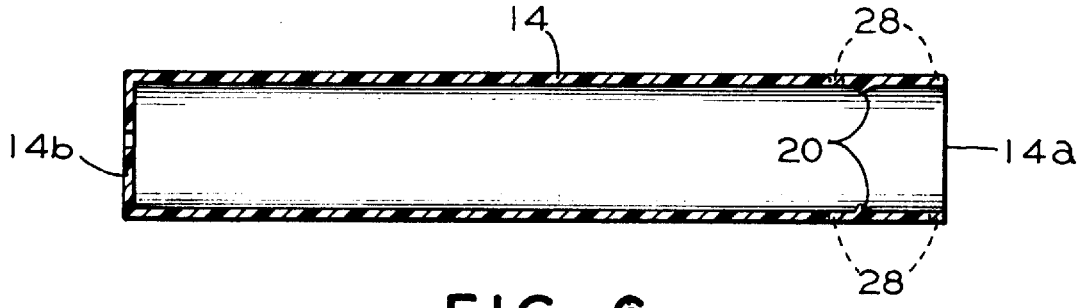
FIG. 6 is a cross-sectional side view of the outer hollow member illustrated in FIGS. 1, 4 and 5 with this sectional side view being at 90 degrees to the side view of FIG. 4, with the section taken at section line VI—VI in FIG. 4.
Figure 5:
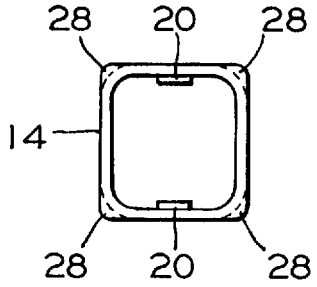
FIG. 5 is an end view of the outer hollow member illustrated in FIGS. 1 and 4 as viewed from the open end.
Figure 4:
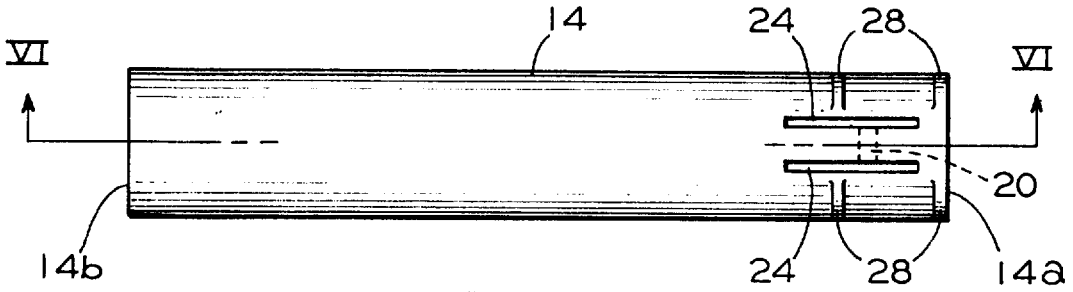
FIG. 4 is a side view of the outer hollow member illustrated in FIG. 1 showing the parallel slots on either side of a protuberance extending inwardly from an inner surface.

While the embodiment of FIGS. 8–11 can be provided with a mating V-shaped protuberance 20 and depressions 18 having sloped side walls, as shown in FIGS. 2 and 6, a more preferred cross-section is to provide abutting side walls which are perpendicular to the elongated direction of the hollow members 12 and 14B on one side of the "V" only as necessary to virtually lock the hollow members 12 and 14B together until such time as thumb-tab 40 is pressed to disengage protuberance 20B from depressions 18B. In this way, the packing container can be virtually locked in the closed position until such time as thumb-tab 40 is pressed to cause withdrawal of protuberance 20B from depressions 18B.

Having described in detail a presently preferred embodiment of this invention, it should be apparent that other embodiments could be utilized and modifications incorporated without departing from the spirit of the invention. For example, the protuberances 20 and depressions 18 could be provided in a number of different and alternate cross-sectional forms provided that the protuberance 20 is designed to engage the depressions 18 with inclined side surfaces so that the sliding engagement can be effected without destroying either the protuberance or depression. To this extent, a hemispherical cross-section interface may be as good as the V-section illustrated in the drawings. In addition, the relative positions of protuberances 20 and depressions 18 could be reversed if desired for any reason. While the above described finger grip flanges 16 and 28 are preferred, such flanges could obviously be provided in different form and even eliminated altogether if thought to be unnecessary in any particular application. Clearly, other modifications could be included and other embodiments designed without departing from the spirit of the invention and the appended claims.

I claim:

1. A packing container assembly particularly for storing and shipping elongated objects comprising:

(a) an inner and an outer elongated hollow member, each having a closed end and an open end, said open end of said inner hollow member being insertable into said open end of said outer hollow member to place said hollow members in longitudinal sliding engagement relative to each other to form said packing container assembly;

(b) a first interlocking means comprising a protuberance formed on an inner surface of a first wall portion of said outer hollow member;

(c) a second interlocking means comprising a plurality of spaced depressions extending inwardly from an outer surface of a second wall portion of said inner hollow member, each of said spaced depressions adapted to receive said protuberance to maintain said hollow members in longitudinal engagement relative to each other to form said packing container assembly;

(d) a pair of elongated slots extending through said first wall portion of said outer hollow member, one each on either side of said protuberance, said elongated slots forming a strip of said first wall portion of said outer hollow member upon which said protuberance is located; and (e) A thumb-tab extending outwardly from said strip of said first wall portion, said thumb-tab adapted to be deflected axially with regard to said elongated hollow members to pivot said protuberance away from said plurality of spaced depressions, thereby disengaging said first interlocking means from said second interlocking means.

2. A packing container assembly, according to claim 1, in which said thumb-tab is disposed transversely between first adjacent ends of said pair of elongated slots, extending perpendicularly from said strip of said first wall portion.

3. A packing container assembly, according to claim 1, in which a living web is provided transversely between second adjacent ends of said pair of elongated slots, said living web adapted to facilitate deflection of said thumb-tab to completely disengage said protuberance from said plurality of spaced depressions.

4. A packing container assembly, according to claim 3, in which said depressions have a generally V-shaped cross-section adapted to receive a protuberance having a mating generally V-shaped cross-section.

5. A packing container assembly, according to claim 4, in which said mating, generally V-shaped cross-sections include abutting edge surfaces thereof which are sufficiently perpendicular to said longitudinal sliding engagement to prevent withdrawal of said inner hollow member from said outer hollow member without deflecting said thumb-tab to completely disengage said protuberance from said plurality of spaced depressions.

6. A packing container assembly, according to claim 1, in which said protuberance has an elongated configuration transverse to the elongated direction of the outer hollow member, and said spaced depressions each have elongated configurations transverse to the elongated direction of the inner hollow member adapted to receive said protuberance having an elongated configuration.

7. A packing container assembly, according to claim 1, in which a pair of said first interlocking means are provided, one each on directly opposed wall portions of said outer hollow member, and in which at least two of said second locking means are provided such that said at least two of said second locking means will engage said pair of said first interlocking means.

8. A packing container assembly, according to claim 1, in which said inner and outer elongated hollow members are in said sliding engagement through a polygonal cross-sectional interface.

9. A packing container assembly, according to claim 8, in which said inner and outer elongated hollow members are in said sliding engagement through a rectangular cross-sectional interface.

* * * * *